US005343213A

United States Patent [19]

Kottke et al.

[11] Patent Number: 5,343,213

[45] Date of Patent: Aug. 30, 1994

[54] SNAP-IN ANTENNA ASSEMBLY

[75] Inventors: Wilfried E. Kottke, Miami; Jill C. Olkoski, Ft. Lauderdale, both of Fla.

[73] Assignee: Motorola, Inc., Schaumburg, Ill.

[21] Appl. No.: 781,544

[22] Filed: Oct. 22, 1991

[51] Int. Cl.[5] ..... H01Q 1/24; H01Q 1/36

[52] U.S. Cl. ..... 343/702; 343/895

[58] Field of Search ..... 343/702, 715, 900, 903, 343/895

[56] References Cited

U.S. PATENT DOCUMENTS

| | | | |
|---|---|---|---|
| 4,121,218 | 10/1978 | Irwin et al. | 343/702 |
| 4,527,168 | 7/1985 | Edwards | 343/901 |
| 4,647,936 | 3/1987 | Taikawa | 343/702 |
| 4,725,845 | 2/1988 | Phillips | 343/702 |
| 4,868,576 | 9/1989 | Johnson et al. | 343/702 |
| 5,079,558 | 1/1992 | Koike | 343/702 |

OTHER PUBLICATIONS

Motorola Drawing No. O1D82714T dated Aug. 26, 1988 shows an antenna assembly having guide bushing with threaded end portion.

*Primary Examiner*—Donald Hajec
*Assistant Examiner*—Tan Ho
*Attorney, Agent, or Firm*—Pedro P. Hernandez

[57] ABSTRACT

An extendable antenna assembly allows for snap-in assembly and quick disconnection thereby saving both time and money in antenna assembly and replacement. The extendable antenna assembly includes an extendable radiating half-wavelength antenna (108) and a helical quarter wavelength antenna (300). The helical antenna (300) includes an antenna section (112) and a support section which includes a number of resilient leg members (116). Some of the leg members (116) include snaps (118) which engage with retention areas (122) which are found in the radio housing (120). A guide tube (102) having a flared top section (124) is found inside the radio (100) and provides for a way of compressing the individual leg members (116) thereby, releasing the extendable antenna assembly from the radio housing (120) when the antenna assembly requires removal.

6 Claims, 4 Drawing Sheets

SNAP-IN ANTENNA ASSEMBLY

TECHNICAL FIELD

This invention relates generally to antenna assemblies, and more specifically to an extendable antenna assembly for communication devices which can be easily installed and removed.

BACKGROUND

As communication devices, such as portable radios, and cellular telephones, become smaller in size, they rely more on extendable antenna assemblies. These antenna assemblies allow for an extendable antenna element to be pulled out by phone users when they need to communicate using a higher gain antenna and then be retracted when the conversation is over and the radio relies on a lower gain internal antenna section. A typical prior art example of this type of antenna assembly can be found in U.S. Pat. No. 4,868,576 issued to Robert M. Johnson, Jr., entitled "Extendable Antenna For Portable Cellular Telephones With Ground Radiator", which is hereby incorporated by reference. Johnson teaches an antenna assembly which includes a quarter-wavelength ground radiator and a helical coil capacitively coupled to an extendable half-wavelength radiator. This provides the communication device user with an internal receive antenna when the device is not involved in a communications exchange and with an extendable half-wave antenna having better gain for when the device has begun the communications exchange.

One major problem with extendable antennas is that the extendable radiator sometimes breaks due to the constant pulling and or abuse the extendable radiator element experiences over time. In prior art designs, once the extendable radiator broke, disassembly of several parts would be required in order to replace the broken antenna. A need therefore exists for an antenna which can be easily connected and removed in order to simplify replacement of a broken antenna and to also simplify original placement of the antenna during manufacture of the communication device.

SUMMARY OF THE INVENTION

Briefly described, the present invention contemplates an extendable antenna assembly which allows for snap-in installation and simple removal.

According to the invention, an antenna comprises an antenna section and an antenna support coupled to the antenna section. The antenna support includes at least one resilient leg member having a snap.

In another aspect of the invention, an extendable antenna assembly comprises an extendable radiating antenna element and a helical antenna having an antenna support which includes at least one resilient leg member and at least one of the resilient legs has a snap.

In still another aspect of the present invention a radio comprises a transmitter means, receiver means, an extendable antenna assembly and an antenna switch means for coupling the transmitter and receiver means selectively to the extendable antenna assembly.

DETAILED DESCRIPTION OF THE PREFERRED EMBODIMENT

Figure 1:
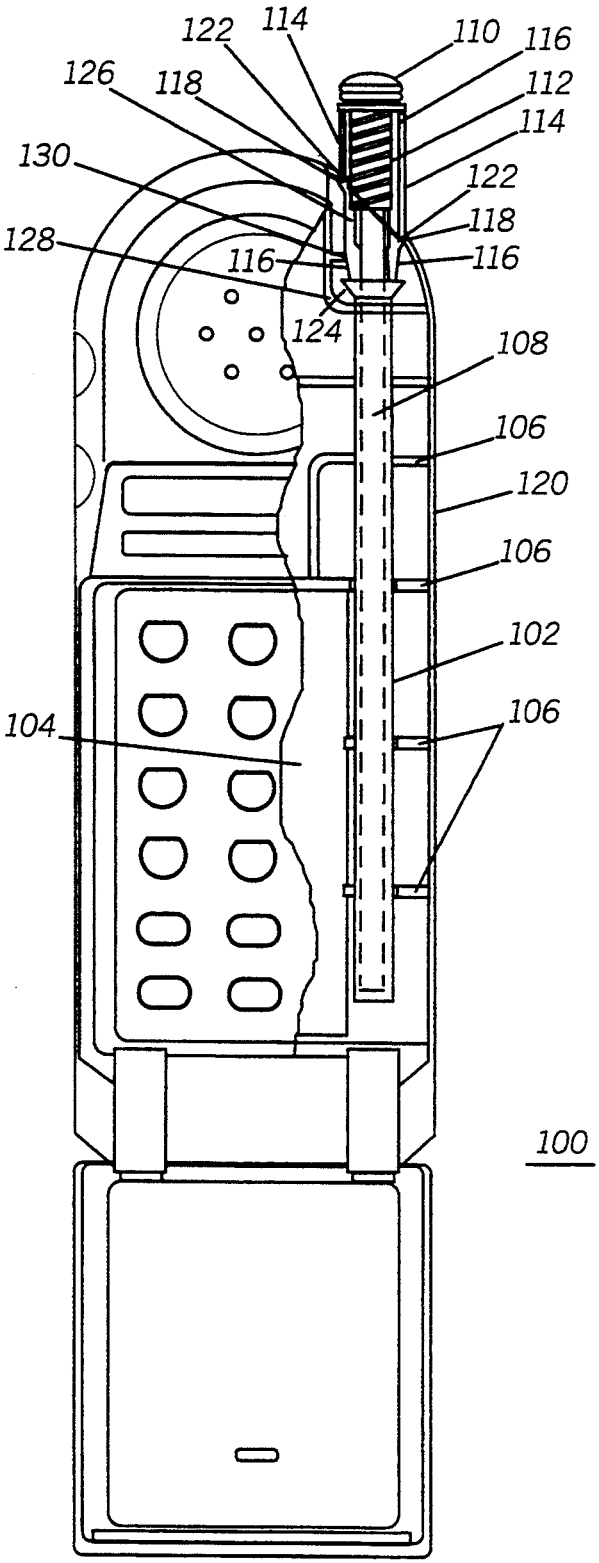
FIG. 1 is a partial cross sectional view of a portable communication device including an extendable antenna assembly embodying the present invention.

Referring now to the drawings and in particular to FIG. 1, there is shown a partial cross-sectional view of a communication device 100 exposing an extendable antenna assembly in accordance with the present invention. The extendable antenna includes a helical quarter-wave antenna which has an antenna section 112 and an antenna support section 126 which includes a plurality of resilient leg members 116. In the preferred embodiment, there are three such leg members 116. Two of the leg members 116 further include snaps 118 which latch onto retention areas 122 found on antenna housing section or boss 114, of device housing 120. The extendable antenna assembly also includes an extendable half-wave radiation element 108, which is shown in FIG. 1 in the retracted position (inside of antenna guide tube 102). When half-wave extendable radiator 108 is placed in the extended position, it becomes capacitively coupled to the quarter wave antenna section 112, thereby providing the communication device user with a half-wave antenna having better gain characteristics. Included as part of the antenna assembly is an antenna guide tube 102 having a flared top section 124. The antenna guide tube 102 is supported inside of the communication device housing 120 by a series of guide tube support portions 106, which are part of device housing 120. A half wave extendable radiator 108 includes a protective end cap 110, which stops extendable radiator element 102 when it is retracted.

As can be seen from FIG. 1, each of the resilient leg members 116 is gathered by flared top section 124, which is located at the top of guide tube 102. Guide tube 102 receives the extendable antenna 108 when it is laced in the retracted position inside of device housing 120. The flared top section 124 of guide tube 102 allows the extendable antenna assembly to be disengaged from radio housing 120, by simply pushing up on guide tube 102 via battery compartment opening 104 found at the back of radio 100. Guide tube 102 is capable of sliding up and down between support portions 128 and 130, flared top section 124 is prevented from further movement by supports 128 and 130. Upon upward force (in the direction of the antenna section 112) being applied to guide tube 102, flared top section 124 causes each of the resilient leg members 116 to compress inwardly, thereby releasing the outward pressure being applied at the snaps 118. This in turn allows antenna section 112 to become disengaged from housing 120 since snaps 118 clear the retention areas 122 which are part of boss 114 (antenna housing section which is part of radio housing 120). Once snaps 118 are cleared, the extendable antenna assembly can be easily removed from radio housing 120 by simple pulling up on antenna section 112.

Antenna section 112 and resilient legs members 116 are preferably manufactured from "Zytel" which is a glass filled nylon, or any other comparable material. The antenna section 112 molds into its body a helical element (wire) having a predetermined number of turns that depend on the frequency of operation of the radio 100. The extendable half-wave radiator 102 is preferably formed from a first layer of "Macroblend UT 1018" or other similar polycarbonate/polyester blend which molds over a conventional helically wound coil that forms the radiator element for the half-wave radiator 108. This is then followed by a second molding of preferably 70 durometer polyurethane. The length, diameter and number of turns of the molded helical coil (molded into radiator 108 and not shown), will determine the operating frequency range for the extendable element 108. In the preferred embodiment, the overall length of extendable radiator 108 including end protective cap 110 is 5.281 inch. The overmoled radiator coil utilized for the extendable element 108 is preferably made from Beryllium copper wire having a diameter of 0.0126 inch with the coil diameter being 0.072 inch. The coil length and number of turns will depend on the operating frequency range radio 100 and can be easily calculated in order to realize a half-wavelength extendable element 108.

Antenna section 112 includes a quarter-wavelength helical coil which is preferably formed from 0.02 diameter beryllium-copper having a coil diameter of 0.205 inch. The coil length and number of turns will again depend on the desired operating frequency for radio 100.

Figure 2:
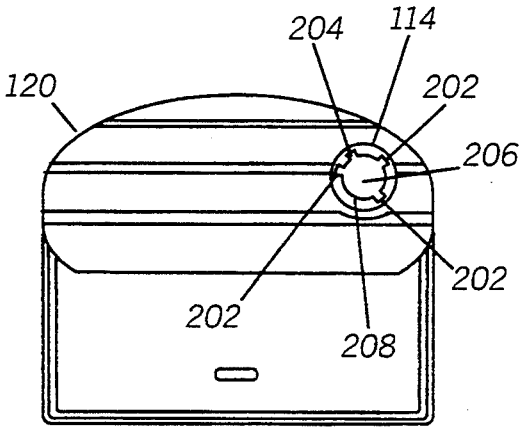
FIG. 2 is a top view of the communication device of FIG. 1 showing the antenna opening in the housing of the communication device.

In FIG. 2, a top view of the communication device housing 120 is shown. Antenna housing section 114 includes an opening 206 having a number of channels 202 for each of the resilient leg portions 116 to slide through. An extra channel 204, is provided for allowing the antenna section end terminal 306 (shown in FIG. 3) to slide through the antenna housing section 114. During original assembly, the extendable antenna system is top mounted or as known in the art "Z-axis mounted" through this top opening in radio 100. Upon the extendable antenna assembly being inserted into opening 206, it is pushed downward until snaps 118 latch onto their corresponding retention areas 122. Retention areas 122 are simply cut outs in the antenna housing section 114 which engage with snaps 118 thereby retaining the helical antenna to radio housing 120.

Figure 3:
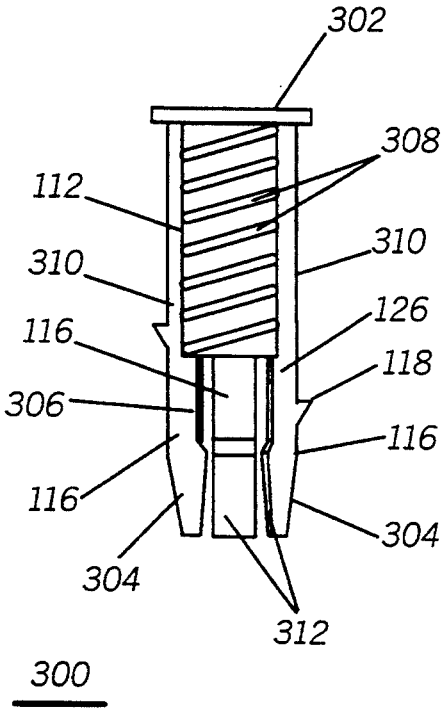
FIG. 3 is a side view of the snap-in helical antenna according to the present invention.

In FIG. 3, a front view of the helical antenna 300 is shown. The helical antenna 300 comprises an antenna section 112 and an antenna support section 126 which is comprised of resilient leg members 116. The antenna section 112 includes a helical coil 308 having an antenna end terminal 306. The helical coil 308 is molded into the antenna section 112. At the top of antenna section 112 is a flange top 302 which helps prevent antenna section 112 from being pressed any further downward than required. Flange top 302 bottoms against the top portion 208 of antenna support portion 114, when antenna section 112 is placed in its retained position (down position), since flange top 302 has a larger diameter than antenna opening 206. Antenna section 112 includes a cavity along its length having a preferred diameter of 0.115 inches which allows the extendable antenna element 108 which has a diameter of 0.110 inch to be retracted and extended through antenna section 112.

Each resilient leg member 116 includes an outer chamfered end portion 304 which helps each of the leg portions 116 become gathered by flared top section 124 of guide tube 102. When guide tube 102 is pushed upward into the leg members 116 each of the individual leg members 116 are compressed inward. Flared top section 124 acts as a funnel causing each of the leg members 116 to be compressed inward which in turn results in snaps 118 disengaging from their respective retention areas 122. In the preferred embodiment, the helical antenna 300 includes two snaps 118, one being at a lower position of one of the leg members 116 than the other. The snap 118 which is higher up the antenna 300 preferably protrudes out less than the lower snap 118 (snap closer to chamfered section 304) since the higher snap is less capable of being deflected inward by the compression of leg members 116 during the antenna assembly removal process. The quantity and location of snaps 118 will depend on several factors including the size of antenna 300, amount of support required, etc. The inner surface 312 of each of the resilient leg portions 116 is preferably flat in order to allow for enough compression tolerance between the extendable radiation element 108 (not shown) and the individual leg portions 116.

Figure 4:
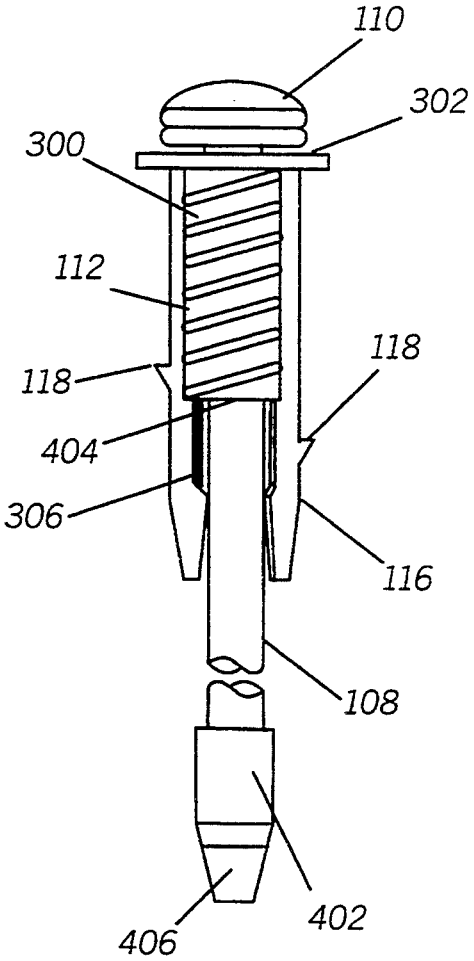
FIG. 4 is a side view of the extendable antenna assembly in accordance with the present invention.

In FIG. 4, helical antenna 300 is shown with extendable radiation element 108 attached. In the preferred embodiment, both members are molded such as they become one interlocking piece, incapable of being separated. Both protective top 110 and stop member or stop collar 402 are molded as part of antenna 108 thereby preventing removal of extendable element 108 from antenna 300. Upon reaching the bottom surface 404 of antenna section 112, stop member 402 prevents radiation element 108 from being pulled up any further. Preferably, the diameter of stop member 402 is wider (in the preferred embodiment 0.125 inch) than the rest of the radiation element 108 (0.110 inch outside diameter excluding top end cap 110) causing leg members 116 to expand outwardly when extendable antenna 108 is extended. Stop member 402 mechanically loads each leg member 116 and in turn, keeps extendable radiation element 108 in the upright position due to the resilient nature of leg members 116. Leg members 116 apply enough inward force on stop member 402 when extendable element 108 is in the retracted position to keep the extendable element in the "Up" position. When stop member 402 reaches the bottom surface 404 of antenna section 112 further tactile feedback is provided to the radio user indicating that the antenna has reached its maximum height. Applying enough downward force on extendable element 108 causes the stop element 402 to push the resilient leg portions 116 outwardly until the stop member clears the leg portions 116, at which point the extendable element 108 can be pushed downward until protective end cap 110 makes contact with antenna support 114 (shown in FIG. 1).

Figure 5:
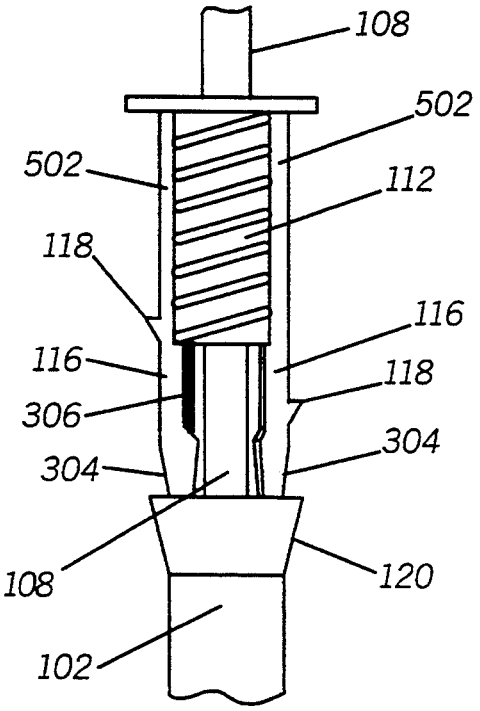
FIG. 5 is a side view of the snap-in antenna and antenna guide tube in accordance with the present invention.

FIG. 5 shows a closer view of leg portions 116 being gathered by flange section 124 of guide tube 102. Also shown are the two snaps 118 which retain antenna section 112. Guide rails 502 are also found running along the length of antenna section 112 and along each individual leg portion 116. Each guide rail 502 helps in the assembly and disassembly of the extendable antenna system shown in FIG. 1 by aligning each leg portion 116 with each individual leg member channel 202 (see FIG. 2).

Figure 6:
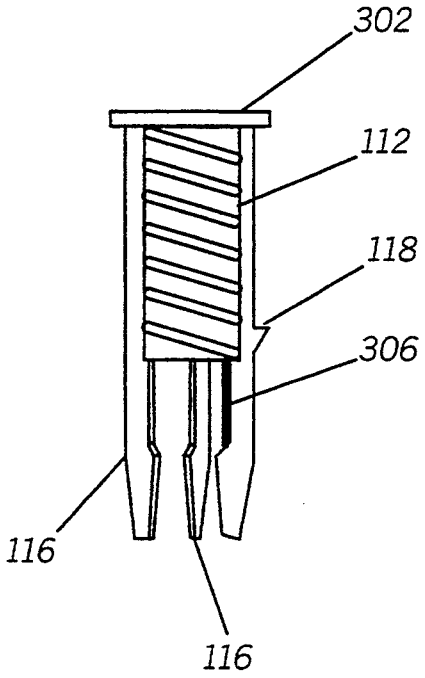
FIG. 6 is another side view of the snap-in antenna of FIG. 4 showing the antenna terminal.

A back view of the helical antenna in accordance with the present invention is shown in FIG. 6. A clear view of the antenna end terminal 306 is shown in this view. Antenna end terminal 306 slides into antenna opening 206 via channel 204 which helps align the antenna end terminal 306 to an antenna connector 602 (shown in FIG. 7) found inside the radio. Antenna end terminal 306 plugs into antenna connector 602 upon the antenna being snapped into place during assembly.

Figure 7:
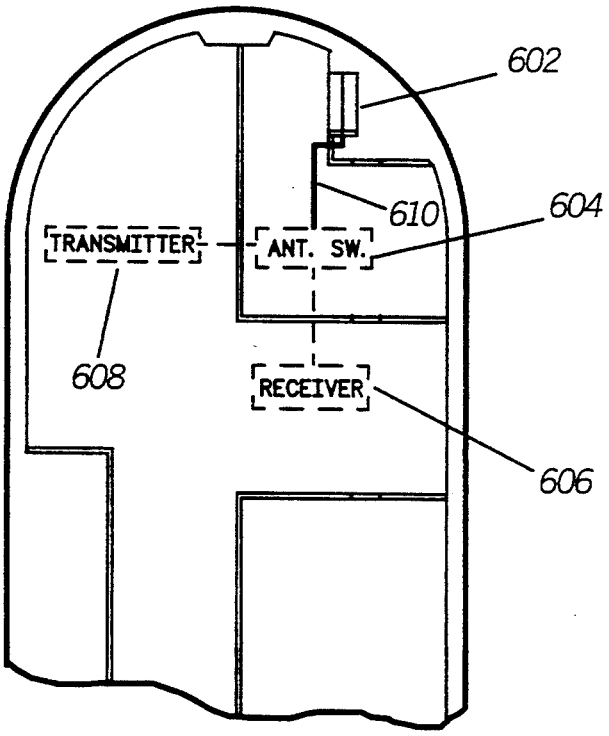
FIG. 7 is a partial view of the communication device of FIG. 1 showing the antenna connector and corresponding transmitter and receiver sections.

In FIG. 7, a partial view of the communication device of FIG. 1 is shown. The communication device in the preferred embodiment is a second generation radio telephone (CT-2), although any type of communication device requiring an antenna can use the present invention. Radio 700 includes conventional transmitter 608 and receiver 606 sections. The receiver 606 and transmitter 608 are selectively coupled to antenna connector 602 via antenna switch 604. Although in the preferred embodiment, radio 700 is a non duplex radio, the present invention can also be utilized in duplex radios such as cellular radio telephones by using a duplexer instead of an antenna switch 604. A good example of such cellular telephone can be found in U.S. Pat. No. 4,868,576 by Johnson, Jr. which was previously incorporated by reference.

Figure 8:
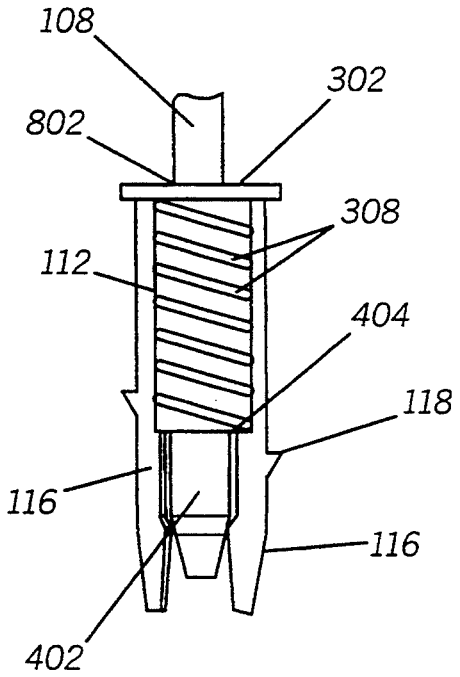
FIG. 8 is a side view of the antenna assembly showing the extendable radiation element in the extended position in accordance with the present invention.

FIG. 8 shows the extendable radiation element 108 in the extended position in accordance with the present invention. Stop member 402 is pressed against bottom surface 404 of antenna element 112. Given that the diameter of stop member 402 is larger than the diameter of the cavity 802 which allows extendable element 108 to slide through helical antenna 300, stop member 402 prevents extendable element 108 from being extended any further. At the same time, the larger diameter of stop member 402 causes the individual resilient leg members to expand outwardly forcing a pressure fit with stop member 402, thereby retaining extendable element 108 in the extended position. Placing enough downward force on extendable element 108 causes stop member 402 to pass through the resilient legs 116 and allows the extendable antenna element 108 to be retracted.

Figure 9:
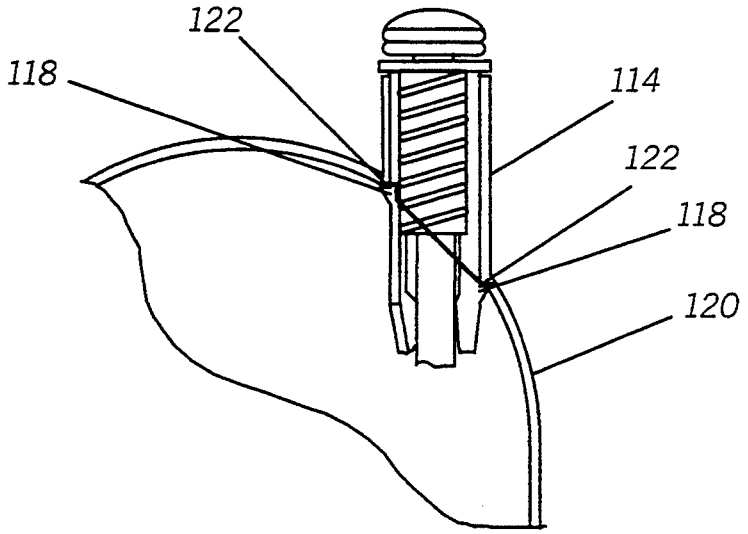
FIG. 9 is a close up view of the antenna section engaged with the housing member in accordance with the invention.

In FIG. 9, a closer view of how helical antenna 300 engages into antenna housing portion 114 of radio housing 120 is shown. Snaps 118 are shown engaged with housing retention areas or slots 122 which are found at the end of two of the housing channels 202.

In summary, an extendable antenna assembly for portable communication devices is capable of easy installation and removal. The extendable antenna assembly provides for simple Z-axis snap-in assembly which reduces the time required to assemble the communication device. Furthermore, by simply pushing up on the antenna guide tube 102, the resilient leg members 116 are contracted thereby disengaging snaps 118 which retain the extendable antenna assembly from the radio housing 120.

The ease of installation and replacement provided by the present invention saves a great amount of time in antenna installation and replacement. The overall part count required to implement an extendable antenna assembly has also been reduced over the prior art, thereby reducing the overall costs of the extendable antenna assembly. The present invention only requires the fixed helical antenna 300 and extendable antenna element 108 which are interlocking parts and a guide tube 102.

What is claimed is:

1. An extendable antenna assembly, for a communication device enclosed in a housing, the housing including an antenna housing portion having an antenna retention area, the extendable antenna assembly comprising:

a helical antenna, the helical antenna including an antenna section having a helical winding and antenna input terminal, the helical antenna further including an antenna support coupled to the antenna section, said antenna support including a resilient leg member having a snap which engages to the antenna retention area;

an extendable antenna extending through the helical winding, the extendable antenna being capacitively coupled to the helical antenna when extended from the antenna housing section; and an antenna guide tube residing inside of the housing for collecting the extendable antenna when the extendable antenna is retracted into the antenna housing section; and the resilient leg member has a chamfered end portion and the antenna guide tube has a flared top portion for gathering and compressing the resilient leg member when the antenna guide tube is pressed against the resilient leg member.

2. The extendable antenna assembly of claim 1, wherein the extendable antenna has top and bottom portions and the bottom portion includes a stop member for stopping the extendable antenna when the extendable antenna has reached the point of furthest extension.

3. An extendable antenna assembly as defined in claim 1, wherein the helical antenna comprises a quarter-wave length helical antenna.

4. A radio having a housing which includes an antenna housing section having a retention area, the radio comprising:

transmitter means;

receiver means;

an extendable antenna assembly, comprising:

a helical antenna, the helical antenna including an antenna section having a helical winding including an antenna input terminal, the helical antenna further including an antenna support coupled to the antenna section, said antenna support including a plurality of resilient leg members and at least one of the plurality of resilient leg members having a snap which engages to the antenna housing section's retention area; and an extendable antenna extending through the helical winding, the extendable antenna being capacitively coupled to the helical antenna when extended from the antenna housing section;

antenna switch means for coupling said transmitter and receiver means selectively to the antenna input terminal; and an antenna guide tube residing inside of the antenna housing section for collecting the extendable antenna when the extendable antenna is retracted into the housing section; and the plurality of resilient leg members have chamfered end portions and the antenna guide tube has a flared top portion for gathering and compressing the plurality of resilient leg members when the antenna guide tube is pressed against the plurality of resilient leg members.

5. The radio of claim 4, wherein the extendable antenna has top and bottom portions and the bottom portion includes a stop member for stopping the extendable antenna when the extendable antenna is fully extended from the antenna housing section.

6. The radio of claim 5, wherein the antenna stop member has a diameter which causes the plurality of resilient leg members to expand outwardly and provide for a pressure fit between the stop member and the plurality of individual leg members.

* * * * *